United States Patent [19]

Hubbard, Jr.

[11] Patent Number: 4,977,878

[45] Date of Patent: Dec. 18, 1990

[54] CARBURETOR IDLER ASSIST SYSTEM

[76] Inventor: Larry M. Hubbard, Jr., 6500½ San Miguel, Bonita, Calif. 92002

[21] Appl. No.: 264,060

[22] Filed: Oct. 28, 1988

[51] Int. Cl.[5] ..... F02M 3/05; F02D 41/08

[52] U.S. Cl. ..... 123/339; 123/360

[58] Field of Search ..... 123/339, 360, 361

[56] References Cited

U.S. PATENT DOCUMENTS 4,354,466 10/1982 Dudley et al. ..... 123/361 X 4,829,960 5/1989 Yuzawa et al. ..... 123/360

*Primary Examiner*—Tony M. Argenbright

*Assistant Examiner*—Robert E. Mates

*Attorney, Agent, or Firm*—Needle & Rosenberg

[57] ABSTRACT

A device for interacting with a throttle of a carburetor to produce a second, constant idle speed having a ram arm with a first end engaging the throttle when the ram arm is in a forward position; a vacuum-operable diaphragm attached to the ram arm for moving the ram arm to the forward position upon application of vacuum pressure; and solenoid-operated means for further maintaining the ram arm in the forward position.

8 Claims, 2 Drawing Sheets

CARBURETOR IDLER ASSIST SYSTEM

BACKGROUND OF THE INVENTION

An internal combustion engine is primarily thought of as a device to propel a vehicle. The internal combustion engine, however, also serves as a source of power generation for subsidiary needs. The result of this dual function is, of course, the use of the internal combustion engine in a dual capacity. As the efficiency of design increases, this dual capacity is more frequently utilized. The requisite control systems for engines in vehicles were initially designed for transportation. As the use of internal combustion as a source of subsidiary power generation increases, there is a need to redesign the control systems to account for this secondary function.

A need has developed for a fast idle device for an internal combustion engine which operates in a failsafe fashion. A device is required which can, upon command, produce a second given idle speed at a rate which can be predetermined. As an example of these needs, consider an ambulance during operation. With the present idle control system devices, the power requirements of a potentially life saving machine might be higher than the engine is capable of producing at its normal idle speed, thereby stalling the engine and cutting off power entirely. Another example is the use of a vehicle which includes a hydraulically operated device where the engine speed must be high enough to develop hydraulic working pressure. In such a case the operator of the vehicle would prefer to have a second idle speed, which would fall in the desired R.P.M. range to develop the hydraulic pressure required.

One other particular concern for engine power is that it be available when necessary. Often a human operator is not available to change the idle speed of the engine. There exists a need for a fast idle device which can be either manually applied by the operator or automatically applied by a second machine which senses the condition of need. There also exists a need for a device which quickly and efficiently brings an engine up to a second predetermined idle speed.

SUMMARY OF THE INVENTION

The present invention is comprised of a throttle engaging ram arm, two means to provide the ram arm motion, and an electro-vacuum valve engaged either manually or automatically. One of the ram arm motive means is a diaphragm operated by using vacuum from the engine intake manifold. The other ram arm motive means is a solenoid operated by electrical current. A frame is provided for support and adjustment of the system.

The failsafe fast idle device of the present invention, by interacting directly with a throttle lever on a carburetor using a ram arm with two modes of motive engagement, enables the device to operate in the event of a vacuum failure. The ram arm is adjustable to allow the second idle speed to be set at any desired R.P.M. Thus, the failsafe fast idle device of the present invention applies a second idle speed at a preset level.

Therefore, it is an object of this invention is to provide a fast idle device which allows an operator to choose and apply a second preset idle speed.

It is another object of this invention to produce a fast idle device which is operated by redundant systems in the event of failure of one of the systems.

It is still another object of this invention to provide a fast idle device which quickly and efficiently brings an engine up to its preset idle speed.

It is yet another object of this invention to provide a fast idle device which is either manually (remotely) or automatically controlled.

DETAILED DESCRIPTION OF THE PREFERRED EMBODIMENT

Figure 1:
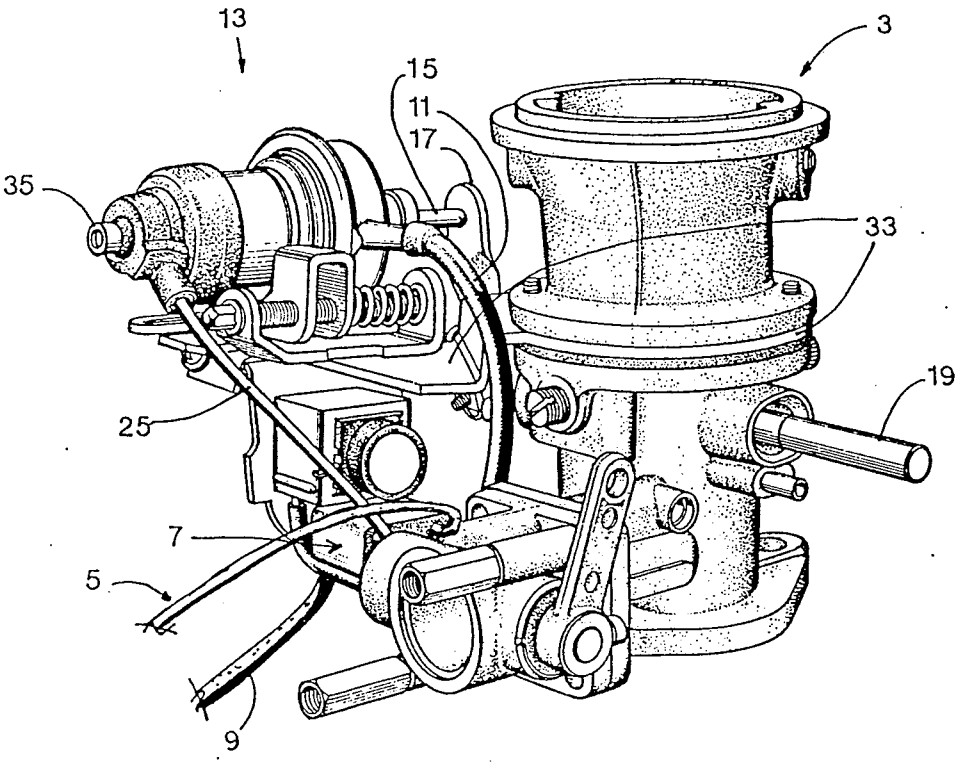
FIG. 1 is a perspective view of the present invention connected to a one barrel carburetor.

Referring initially to FIG. 1, an embodiment of the present invention 1 is shown in conjunction with a one barrel carburetor 3. The device is activated by manually closing a switch (not shown) at a remote location (e.g. dashboard), supplying electrical current through wire 5 to the electro-vacuum valve 7. Alternatively, this electrical current could be automatically supplied by a second device which senses its own need for increased power. When energized, a vacuum port within the electro-vacuum valve 7 opens. Vacuum from the engine intake manifold (15–18 in. Hg) is supplied to the electro-vacuum valve 7 through vacuum tube 9. The vacuum is allowed through the open vacuum port (not shown) within the electro-vacuum valve 7. This vacuum pressure is applied through vacuum tube 11 to the solenoid/vacuum ram arm device 13. A diaphragm 23 within the solenoid/vacuum ram arm device 13 deflects under the vacuum pressure, extending the ram arm 15. The ram arm contacts the throttle lever 17, which translates the axial motion of the ram arm to circular motion of the carburetor throttle rod 19. The throttle rod rotates the throttle blades (not shown) within the carburetor to increase the engine RPM.

Figure 2:
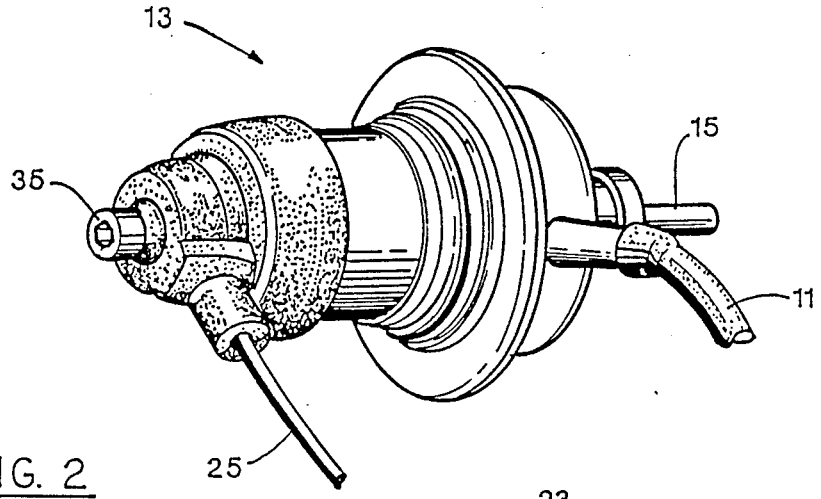
FIG. 2 is a partially cut away section of the solenoid/vacuum ram arm device.
Figure 3:
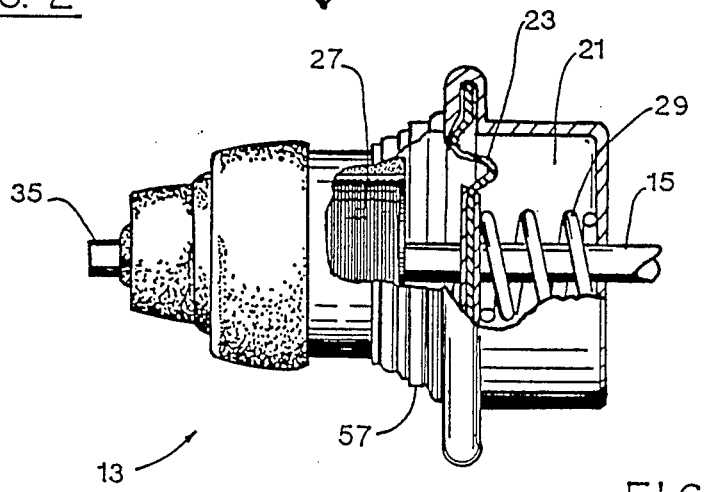
FIG. 3 is a perspective view of the support and adjustment arrangement for the present invention.

The solenoid/vacuum ram arm device 13 is detailed in FIGS. 2 and 3. Vacuum is applied through tube 11 to the vacuum chamber 21. The diaphragm 23 flexes due to the pressure differential (atmospheric and vacuum). The ram arm 15 is mechanically connected to the diaphragm 23. The diaphragm 23 flexing motion is therefore translated to an axial motion of the ram arm 15. At the same time the current applied to the electro-vacuum valve 7 opens the vacuum port (not shown), electrical current is transferred from the electro-vacuum valve 7 through wire 25 to the solenoid/vacuum ram arm device 13. The current energizes the solenoid 27 portion of the solenoid/vacuum ram arm device 13. The solenoid 27 assists the diaphragm 23 in transmitting an axial motion to the ram arm 15. Once the ram arm 15 has reached the engaged position, the solenoid 27 acts as a holding coil to maintain the ram arm 15 in that position.

To disengage the device (i.e., allow the engine to return to normal idle), the operator opens the remote switch. This, in turn, cuts the current flow to the electro-vacuum valve 7. The vacuum port (not shown) closes, shutting off the flow of vacuum to the solenoid/-vacuum ram arm device 13. As the pressure in the vacuum chamber 21 equalizes to atmospheric, spring 29 moves the diaphragm 23 and ram arm 15 back to the original, disengaged position. At the same time, current to the solenoid 27 is interrupted, losing the effect as a holding coil. When the ram arm 15 is no longer engaged, the carburetor throttle returns the engine to normal idle speed.

The engine speed achieved when the device is engaged is easily adjusted two ways. Coarse adjustment of speed is accomplished by the sliding mounting bracket 31 moving on the support bracket 33. This is further detailed in FIG. 3 and described below. Fine adjustment of speed is accomplished by turning the ram arm adjustment nut 35 which internally contacts the ram arm 15 in the solenoid/vacuum ram arm device 13.

FIG. 3 shows the support and adjustment arrangement for the solenoid/vacuum ram arm device 13. The support bracket 33 is rigidly attached to the carburetor 3. (see also FIG. 1). The support bracket is fabricated with two ears 37 bent at 90° containing oversize holes 38 drilled in line through each ear 37 to accept adjusting bolt 39. A spring 41 insures that no slack occurs between the support bracket 33 and the sliding mounting bracket 31. A retainer 43 on the adjusting bolt 39 keeps the bolt in position through the ears 37.

Figure 4:
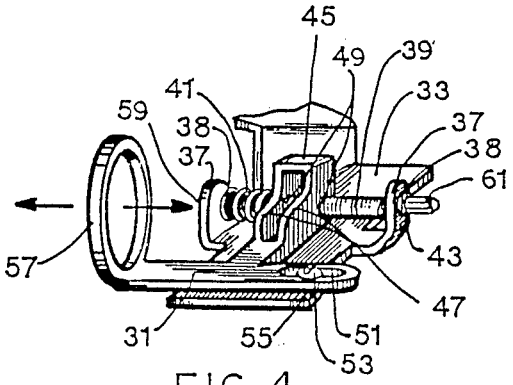
FIG. 4 is a perspective view of the sliding mounting bracket of the present invention.

The sliding mounting bracket 31 is fabricated to provide several features, as shown in FIG. 4. The adjustment arm 45 is actually two parallel plates 47. Holes have been drilled and tapped 49 to engage the adjusting bolt 39. The sliding mounting bracket 31 also has a slotted hole 51. A bolt 53 passes through the slotted hole 51 in the sliding mounting bracket 31 to a round hole 55 in the support bracket 33 to maintain axial alignment during adjustment. A support ring 57 is provided to mount the solenoid/vacuum ram arm device 13 on the sliding mounting bracket 31.

Coarse adjustment is accomplished by turning the adjusting bolt 39 with a conventional wrench from either end. The bolt head 59 is conventional SAE guage. The opposite end (threaded end) 61 of the adjusting bolt 39 has been machined to also accept a conventional wrench. As the adjusting bolt 39 is turned, the tapped holes 49 in the adjustment arm 45 engage, translating the circular, adjusting bolt 39 motion to axial motion of the sliding mounting bracket 31. This, in turn, varies the extended position of the ram arm 15 with respect to the throttle lever 17. The difference adjusts the speed of the engine with the device engaged.

What I claims is:

1. A device for interacting with a throttle of a carburetor to produce a second, constant idle speed comprising:

(a) a ram arm engaging said throttle when said ram arm is in a forward position;

(b) a vacuum-operable diaphragm attached to said ram arm for moving said ram arm to said forward position upon application of vacuum pressure;

(c) solenoid-operated means for further maintaining said ram arm in said forward position; and (d) means for changing the positioning of said device in relation to said throttle.

2. The device of claim 1, and further comprising biasing means for moving said ram arm back to original, disengaged position.

3. The device of claim 1, and further comprising means for changing the position of the ram arm in relation to said throttle.

4. The device of claim 1, wherein said means for changing the position of said device in relation to said throttle lever comprises:

(a) a support bracket;

(b) a sliding mounting bracket attaching said device to said support bracket; and (c) biasing means eliminating slack between said support bracket and said gliding mounting bracket;

5. The device of claim 1, and further comprising means for controlling said vacuum diaphragm and solenoid means.

6. The device of claim 5, wherein said means for controlling said vacuum diaphragm and solenoid means comprises an electro-vacuum valve.

7. The device of claim 6, wherein said electro-vacuum valve is manually controlled by the user.

8. The device of claim 6, wherein said electro-vacuum valve is automatically controlled.

* * * * *